US010954092B2

(12) United States Patent
Rolion et al.

(10) Patent No.: US 10,954,092 B2
(45) Date of Patent: Mar. 23, 2021

(54) MANUAL DEVICE FOR APPLYING A COATING ON A SUBSTRATE USING A TAPE, HAVING AN IMPROVED END PIECE

(71) Applicant: SOCIETE BIC, Clichy (FR)

(72) Inventors: Franck Rolion, Asnières sur Oise (FR); Samuel Malinverni, Paris (FR)

(73) Assignee: SOCIETE BIC, Clichy (FR)

( * ) Notice: Subject to any disclaimer, the term of this patent is extended or adjusted under 35 U.S.C. 154(b) by 43 days.

(21) Appl. No.: 16/069,782

(22) PCT Filed: Jan. 12, 2017

(86) PCT No.: PCT/FR2017/050065

§ 371 (c)(1),
(2) Date: Jul. 12, 2018

(87) PCT Pub. No.: WO2017/121960

PCT Pub. Date: Jul. 20, 2017

(65) Prior Publication Data

US 2019/0031462 A1 Jan. 31, 2019

(30) Foreign Application Priority Data

Jan. 15, 2016 (FR) ..... 1650316

(51) Int. Cl.
*B65H 37/00* (2006.01)

(52) U.S. Cl.
CPC ..... *B65H 37/007* (2013.01); *B65H 2402/41* (2013.01)

(58) Field of Classification Search
CPC ..... B65H 37/007; B65H 2402/41
See application file for complete search history.

(56) References Cited

U.S. PATENT DOCUMENTS 4,853,074 A * 8/1989 Manusch ..... B65H 37/007 156/577
4,997,512 A * 3/1991 Manusch ..... B05C 17/10 100/211

(Continued)

FOREIGN PATENT DOCUMENTS

EP 0386500 A1 9/1990
EP 1332998 A1 8/2003

(Continued)

OTHER PUBLICATIONS

International Search Report dated Jul. 5, 2017 from corresponding International PCT Application No. PCT/FR2017/050065, 4 pages.

*Primary Examiner* — Alex B Efta
(74) *Attorney, Agent, or Firm* — Ohlandt, Greeley, Ruggiero & Perle, L.L.P.

(57) ABSTRACT

A manual device for applying a coating on a substrate by means of a tape has an applicator endpiece assembled to a casing and projecting from the casing. The applicator endpiece extends along a longitudinal direction and a lateral direction. The applicator endpiece has an attachment portion for assembling it to the casing, an applicator portion for applying the coating on the substrate, and a stem extending along the longitudinal direction between the attachment portion and the applicator portion. The stem is elastically deformable in such a manner that the applicator portion is movable between a rest position and an application position. The stem is an iso-stress stem.

7 Claims, 4 Drawing Sheets

(56) References Cited

U.S. PATENT DOCUMENTS

| | | | | |
|---|---|---|---|---|
| 5,125,589 | A | 6/1992 | Manusch | |
| D420,389 | S | 2/2000 | Shimizu | |
| 6,059,002 | A | 5/2000 | Katami | |
| 6,270,578 | B1 | 8/2001 | Murakoshi | |
| 6,273,169 | B1 | 8/2001 | Ono et al. | |
| 6,360,805 | B1 * | 3/2002 | Takahashi | B65H 37/007 118/257 |
| D456,450 | S | 4/2002 | Kimura | |
| 6,363,990 | B1 * | 4/2002 | Kozaki | B65H 37/007 118/76 |
| D457,564 | S | 5/2002 | Kimura | |
| 6,450,231 | B1 * | 9/2002 | Ishikawa | B65H 37/007 118/200 |
| 6,481,485 | B1 | 11/2002 | Herrmannsen et al. | |
| 6,620,239 | B2 | 9/2003 | Yen | |
| 6,681,827 | B2 | 1/2004 | Tamai et al. | |
| 6,729,377 | B2 | 5/2004 | Huthmacher | |
| 6,776,209 | B1 | 8/2004 | You | |
| 6,792,664 | B2 | 9/2004 | Herrmannsen et al. | |
| 6,997,229 | B2 | 2/2006 | Marschand et al. | |
| 7,044,136 | B2 | 5/2006 | Lee | |
| 7,044,187 | B2 | 5/2006 | Bebensee et al. | |
| 7,163,040 | B2 | 1/2007 | Marschand et al. | |
| D541,863 | S | 5/2007 | Gerules | |
| D543,239 | S | 5/2007 | Suzuki | |
| 7,228,882 | B2 | 6/2007 | Marschand et al. | |
| 7,334,622 | B2 | 2/2008 | Stade | |
| D567,291 | S | 4/2008 | Li | |
| D577,384 | S | 9/2008 | Lin | |
| D588,645 | S | 3/2009 | Burton et al. | |
| D594,907 | S | 6/2009 | Ariga | |
| D601,630 | S | 10/2009 | Wu | |
| D603,903 | S | 11/2009 | Gallay | |
| 7,681,616 | B2 | 3/2010 | Marschand et al. | |
| D661,353 | S | 6/2012 | Ariga | |
| D662,988 | S | 7/2012 | Cooper et al. | |
| 8,573,277 | B2 | 11/2013 | Fueki | |
| 8,573,279 | B2 | 11/2013 | Fueki | |
| 2004/0007331 | A1 * | 1/2004 | Tamai | B65C 11/004 156/577 |
| 2004/0118523 | A1 * | 6/2004 | Stade | B65H 37/007 156/579 |
| 2005/0056375 | A1 | 3/2005 | Marschand | |
| 2005/0150606 | A1 * | 7/2005 | Marschand | B65H 37/007 156/577 |
| 2010/0071853 | A1 | 3/2010 | Wu | |
| 2014/0255078 | A1 | 9/2014 | Malinverni et al. | |

FOREIGN PATENT DOCUMENTS

| | | | |
|---|---|---|---|
| FR | 2981057 | A1 | 4/2013 |
| JP | 2010163571 | A * | 7/2010 |

* cited by examiner

MANUAL DEVICE FOR APPLYING A COATING ON A SUBSTRATE USING A TAPE, HAVING AN IMPROVED END PIECE

TECHNICAL FIELD

The invention relates to the field of manual devices for using a tape to apply a coating on a substrate, and it relates more particularly to the applicator endpiece of such a device. Such devices are sometimes referred to as by the terms "mouse" or "tape applicator", and they are used particularly, but not exclusively, in offices. By way of example, the coating may be adhesive or it may be a white or colored coating.

BACKGROUND

It is often difficult to apply the coating on a substrate with the help of known manual devices. In order to deposit the coating on the substrate correctly (i.e. in order to unwind the tape and transfer the coating from the tape onto a substrate), predetermined application conditions must be met, in particular concerning pressure and relative position of the substrate, which are generally not complied with by the user. In addition, known manual devices for facilitating deposition of the coating present reliability and ergonomics that are in general not satisfactory. There therefore exists a need in this sense.

SUMMARY

An embodiment provides a manual applicator device for applying a coating on a substrate by means of a tape, the device comprising an applicator endpiece assembled to a casing and projecting from said casing, the applicator endpiece extending along a longitudinal direction and a lateral direction, the applicator endpiece comprising an attachment portion for assembling it to the casing, an † Translation of the title as established ex officio. applicator portion for applying the coating on the substrate, and a stem extending along the longitudinal direction between the attachment portion and the applicator portion, the stem being elastically deformable in bending in such a manner that the applicator portion is movable between a rest position and an application position, the stem being a iso-stress stem.

Below, and unless specified to the contrary, the term "endpiece", refers to an "applicator endpiece". In addition, the term "manual device" refers to a "manual device for applying a coating on a substrate by means of a tape".

Naturally, the manual applicator device of the invention may equally well be of the rechargeable type or of the disposable type. If the manual device is of the rechargeable type, then the endpiece is mounted on the casing of an interchangeable cassette. In those circumstances, the endpiece is mounted on an outer casing of the manual device by means of the casing of the interchangeable cassette.

The attachment portion is the portion by which the endpiece is mounted on the casing. In a variant, the endpiece has a single attachment portion.

The applicator portion is the portion of the casing that co-operates with the tape in order to deposit the coating on the substrate. The applicator portion is connected to the attachment portion by the stem. The applicator portion includes an applicator edge extending in the lateral direction, this applicator edge being configured to co-operate with the tape by bearing against the face of the tape that is opposite from the face of the tape carrying the coating. In other words, the tape is arranged longitudinally around the endpiece by wrapping over the stem so as to go around the applicator portion.

The term "elastically deformable in bending", is used to mean that the stem is elastically deformable in bending more easily than any of the other portions of the endpiece. In particular, the bending stiffness of the stem is at least ten times smaller than the bending stiffness of any other portions of the endpiece (i.e. the stem is at least ten times more flexible than any of the other portions of the endpiece).

A iso-stress stem is a stem in which stresses are equal over the entire length of the stem when the stem is subjected to bending stress. In particular, the cross-section of such a stem varies progressively along the entire length of said stem. This makes it possible to avoid any concentration of stress in any one portion of the stem, thereby serving in particular to improve its resistance to creep. The reliability of the endpiece over time is thus improved.

The stem being elastically deformable in bending ensures that when the user applies the applicator portion against the substrate, the applicator portion is brought into the application position. By bringing the applicator portion into the application position, the user is forced to position the manual device relative to the substrate in a position that favors depositing the coating on the substrate. By way of example, in the application position, the angle between the portion of the tape carrying the coating and the substrate, at the point of contact between the applicator portion and the substrate, is greater than or equal to 40°.

In addition, by bringing the applicator portion into the application position, the user applies a certain amount of pressure on the tape at the applicator edge. This ensures that the user applies a pressure on the tape in the application position that is greater than or equal to a predetermined pressure, which likewise favors depositing the coating correctly on the substrate.

Finally, since the stem is a iso-stress stem, the robustness and reliability of the endpiece, as well as its durability over time, are ensured, even after a certain number of cycles of use (i.e. bending of the stem), while presenting bending stiffness that makes the manual device pleasant to use for the user.

Thus, such a manual device encourages the user to use the device under satisfactory application conditions while presenting a degree of reliability and being ergonomic to use.

In some embodiments, the stem presents a cross section that is strictly decreasing in the longitudinal direction going from the attachment portion to the applicator portion.

By way of example, the section of the stem is solid, and circular, oblong, elliptical, parallelepipedal, rectangular, or polygonal in shape, which facilitates manufacturing to some extent, but naturally, the solid or hollow shape of the section is not limiting.

Such a stem forms a iso-stress stem that is easy to manufacture and to integrate into the endpiece.

In some embodiments the device includes an abutment (or first abutment) configured, when the applicator portion passes from the rest position to the application position, to limit the movement of the applicator portion in a direction that is perpendicular both to the longitudinal direction and to the lateral direction.

It should be understood that when the endpiece is in the application position it co-operates with the abutment by bearing against it. Thus, the abutment makes it possible for the applicator position to be adjusted (by the designer/manufacturer) and to be identified clearly (by the user). Such an abutment also makes it possible to avoid excess stresses on the iso-stress stem and to ensure its durability.

In some embodiments, the clearance between the abutment and the endpiece in the rest position is greater than or equal to 1.0 mm (millimeter).

Clearance selected from this range of values makes it possible to ensure application conditions that are satisfactory, while also providing the user with a degree of comfort in use. In order to travel over such a stroke, the user is encouraged to tilt the manual device relative to the substrate, whereby the user positions the manual device in a position that favors depositing the coating of the tape, while preserving comfortable handling of the manual device.

In some embodiments, the stem in the rest position is prestressed in bending in a direction that is perpendicular both to the longitudinal direction and to the lateral direction.

By way of example, the manual device includes a second abutment opposite from the first abutment relative to the endpiece, the endpiece co-operating with the second abutment in the rest position.

Such prestress makes it possible to limit the stroke required to bring the endpiece into the application position from the rest position, whereby it is made more ergonomic and the user can bring the manual device more easily into a position that favors application. In addition, such prestress provides the user with tactile feedback that improves the perceived quality of the manual device, by avoiding the endpiece being sloppy while in the rest position. By way of example, the prestress lies in the range 0.1 N (Newtons) to 1.0 N. Such prestress values are lower than the stress required for depositing the coating on a substrate (i.e. in order to unwind the tape and transfer the coating from the tape onto a substrate), thereby ensuring that the user must deform the stem in bending, and therefore adopt a suitable application position, before being able to apply the coating.

In some embodiments, the bending stiffness of the stem lies in the range 0.13 N/mm (Newton per millimeter) to 1.35 N/mm, while the application pressure required for applying the coating of the tape on the substrate lies in the range 0.10 MPa (MegaPascals) to 1.02 MPa.

It should be observed that the application pressure required for depositing the coating on the substrate corresponds to the pressure that it is necessary to apply in order to entrain the tape and to transfer the coating from the tape onto the substrate.

The application pressure P exerted on the tape is directly proportional to the bending stiffness K (expressed in millimeters) of the stem and to the movement D of the applicator portion, i.e. $P=D\times K$. It should be recalled that 1 MPa=1 $N/mm^2$ (Newton per square millimeter).

The combination of these ranges of values for the bending stiffness of the stem and for the application pressure required for depositing the coating makes it possible to ensure satisfactory application conditions, while providing the user with a degree of comfort in use.

In some embodiments, the movement D of the applicator portion corresponding to the clearance and the bending stiffness K of the stem are such that their product is less than the application pressure required for depositing the coating of the tape on the substrate, i.e. $D\times K<P$.

In some embodiments, the abutment (or first abutment) co-operates in abutment with the endpiece in the vicinity of the connection between the stem and the applicator portion.

The term "in the vicinity of the connection between the stem and the applicator portion" refers to the zone that extends over 30% of the length of the stem along the longitudinal direction around the connection between the stem and the applicator portion.

By arranging the abutment in this way, it is ensured that the stem is stressed on passing from the rest position to the application position, while remaining in its elastic domain, thereby avoiding any stresses that could tend to degrade the stem, e.g. by deforming it plastically. This ensures that the manual device is reliable and therefore that favorable application conditions are reproduced in sustainable manner.

In some embodiments, the casing presents an intermediate portion, said intermediate portion presenting a wall designed to face the substrate during application, said wall presenting a curved shape, the applicator portion in the rest position being arranged at least partly outside the curve resulting from geometrically extending the curved shape of the wall, and inside said curve when in the application position.

When the manual device is of the rechargeable type and the endpiece is mounted on the casing of an interchangeable cassette, it should be observed that the intermediate portion belongs to the outer casing of the manual device and not to the casing of the cassette.

It should be understood that the intermediate portion is a portion that is adjacent to a distal end portion of the casing of the manual device, from which distal end portion the endpiece projects.

It should also be understood that the curved shape of the wall of the intermediate portion facing the substrate during application is oriented in such a manner that the center of curvature is arranged on the same side as the user's hand, i.e. opposite from the substrate relative to the manual device.

Naturally, such a curved shape encourages the user to pivot the manual device relative to the substrate in such a manner as to bring it into a position that favors depositing the coating.

In addition, the fact that the endpiece is placed outside the curve resulting from geometrically extending the curved shape of the wall in the rest position, generates discomfort that forces the user to press on the applicator portion of the endpiece, whereby the endpiece is moved into its application position by being subjected to a certain amount of pressure, which pressure favors depositing the coating on the substrate and creates satisfactory application conditions.

In some embodiments, the applicator endpiece presents an applicator edge, while the casing presents an intermediate portion and a distal end portion separated by a junction, the angle between the straight line passing through the applicator edge and the junction between the intermediate portion and the distal end portion of the casing, and the longitudinal direction is greater than 40° (degrees of angle) in the application position.

It should be understood that the casing of the manual device presents a geometrical discontinuity, e.g. a line or a point of inflection between the intermediate portion and the distal end portion, this discontinuity forming the junction between these two portions.

By way of example, the reference point of the attachment portion through which said straight line passes is the midpoint of the segment defined by the intersection between the straight line extending the neutral axis of the stem and the general outside shape of the attachment portion in the connection zone between the stem and the attachment portion.

Such an angle between the two straight lines passing respectively through the applicator edge and the junction and through the applicator edge and the attachment portion, forces the user to position the applicator endpiece relative to the substrate in a position that favors depositing the coating on the substrate.

BRIEF DESCRIPTION OF THE DRAWINGS

The invention and its advantages can be better understood on reading the detailed description of various embodiments of the invention given as non-limiting examples. The description refers to the accompanying sheets of figures, in which.

DETAILED DESCRIPTION OF EMBODIMENTS

An embodiment of the manual device of the invention for applying a coating on a substrate by means of a tape is described with reference to FIGS. 1 to 5B.

Figure 1:
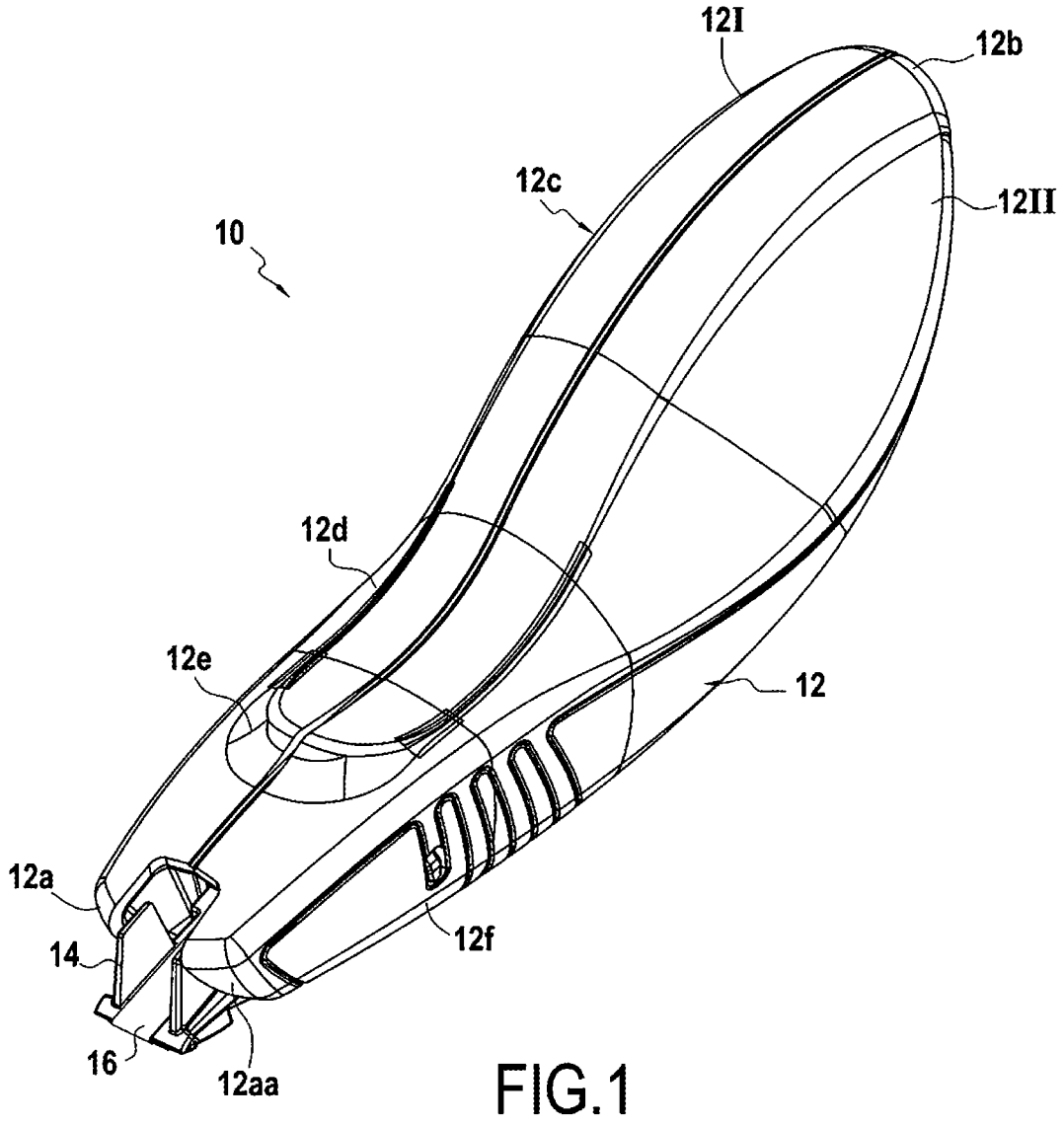
FIG. 1 shows a manual device seen in perspective.

FIG. 1 shows a manual device 10 for applying a coating on a substrate by means of a tape, seen in perspective. The manual device 10 comprises a casing 12, in this example an outer casing 12, an applicator endpiece 14 projecting from said casing 12 and a tape 16, said tape 16 including a coating (not shown) configured to be transferred onto a substrate. In this example, the casing 12 forms a grip handle for manipulating and using the manual device 10.

The casing 12 is substantially crescent shaped, presenting a first distal end 12*a* from which the endpiece 14 extends and a second distal end 12*b* opposite from the first distal end 12*a*. In use, the concave side of the crescent shape faces away from the substrate, and consequently, the convex side is arranged facing the substrate. From the second end 12*b* to the first end 12*a*, on the concave side of the crescent shape, the casing 12 presents a bulge (or convex shape) 12*c* followed by a recess (or concave shape) 12*d* and by a bearing portion 12*e*. The bearing portion 12*e* is configured to hold the user's thumb during use of the manual device 10. In general, on its side facing away from the substrate during use, the manual device 10 presents a bearing portion for holding the user's thumb during use.

Figure 5A:
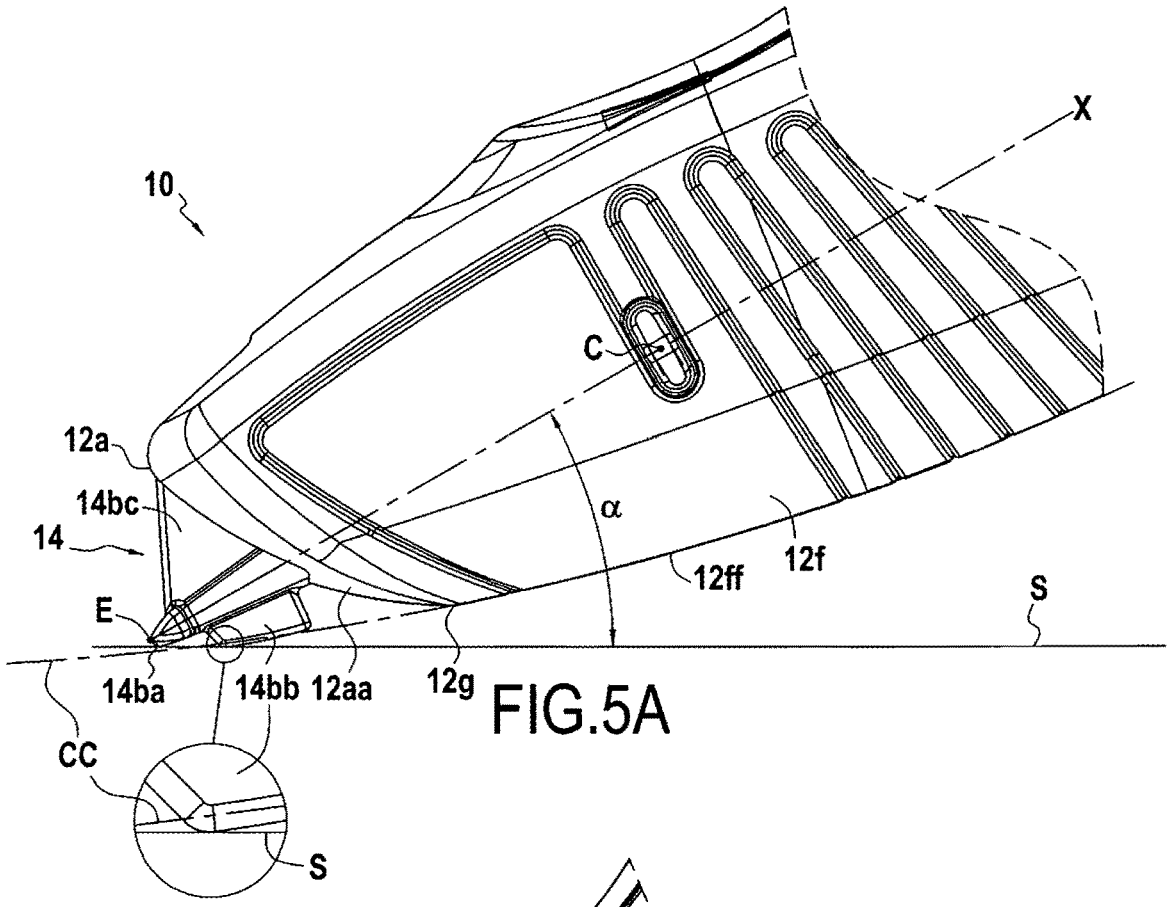
FIG. 5A shows the position of the manual device relative to a substrate on moving closer to the substrate.
Figure 5B:
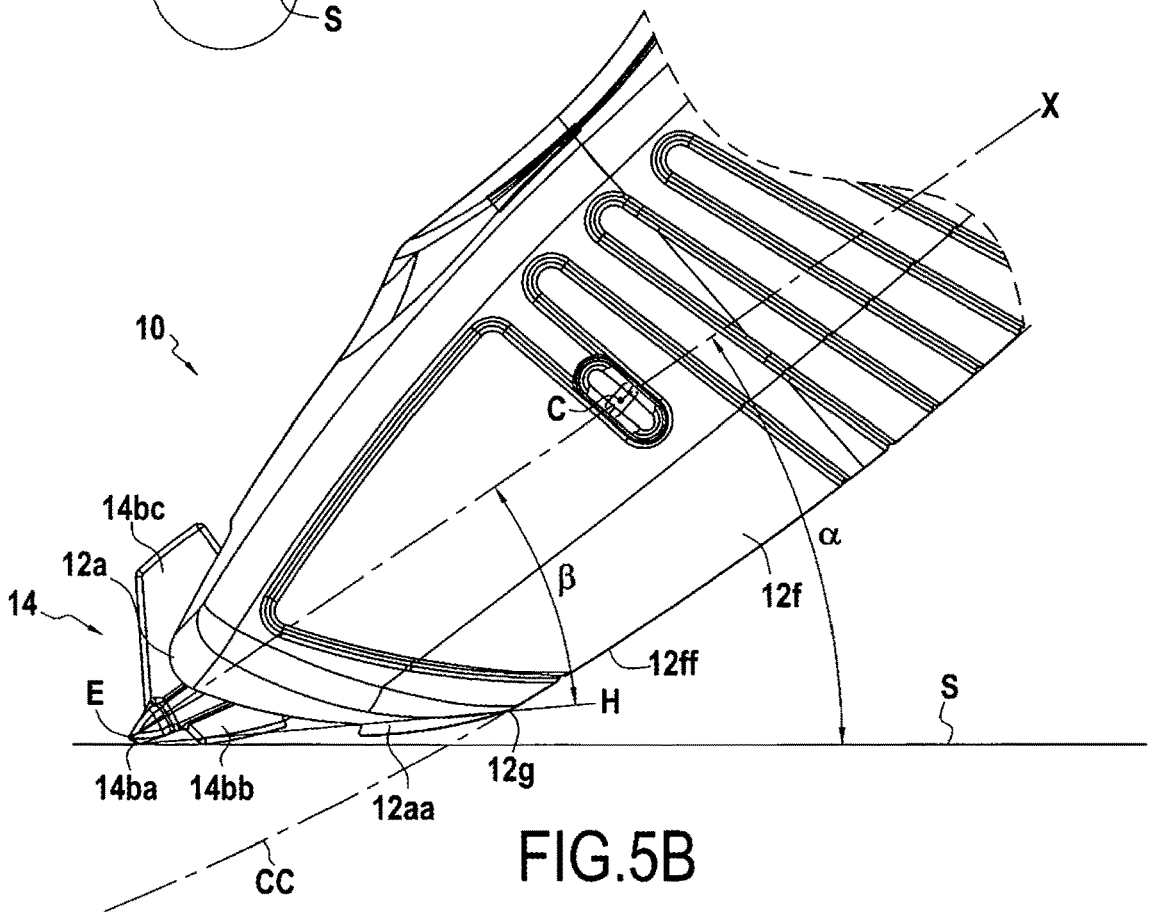
FIG. 5B shows the position of the manual device relative to the substrate during application on the substrate.

As can be seen in FIGS. 5A and 5B, the portion of the casing 12 presenting the distal end 12*a* forms the distal end portion 12*aa*. The casing 12 also presents an intermediate portion 12*f* that is adjacent to the distal end portion 12*aa* and that is separated from the distal end portion 12*aa* by a geometrical discontinuity 12*g*. The face 12*ff* of the intermediate portion 12*f* facing the substrate S during application presents a curved shape, in this example a circularly arcuate shape having a radius lying in the range 15 mm to 25 mm, the center of curvature naturally being disposed on the side of the casing 12 that is remote from the substrate S.

Figure 2:
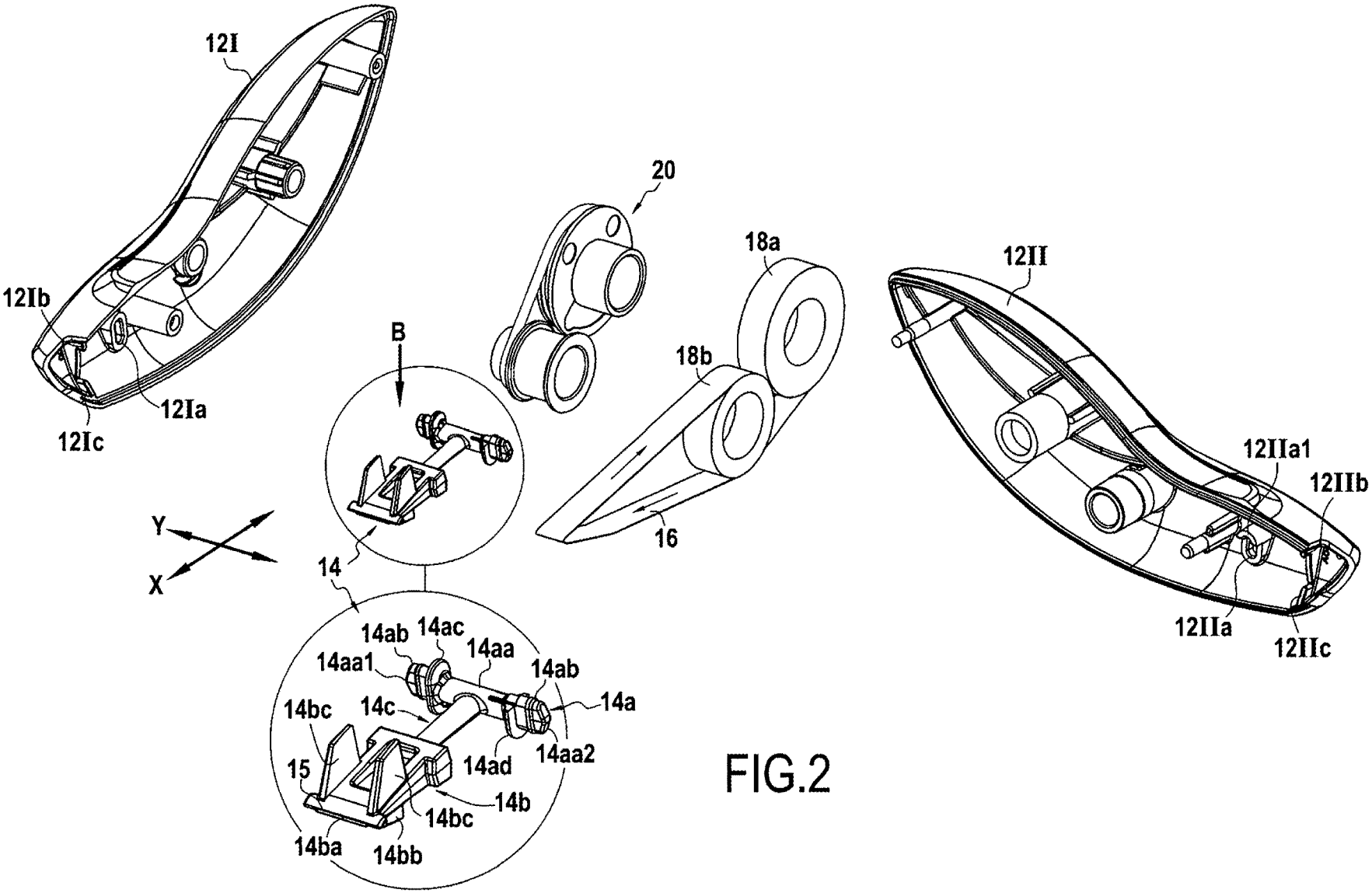
FIG. 2 shows the FIG. 1 manual device, in an exploded view.

In this example, the casing 12 comprises two half-casings 12I and 12II housing reels 18*a* and 18*b* respectively for paying out and for taking up the tape 16, and a mechanism 20 associated therewith. In this example, the mechanism 20 is a mechanism having wheels that are coupled in rotation by a belt, but any other type of mechanism could naturally be envisaged. It should be observed that the tape 16 is paid out from the reel 18*a* in such a manner that the coating (not shown) faces outwards, extends longitudinally around the endpiece 14 by wrapping over a stem 14*c* of the endpiece (described below) so as to go around an applicator portion 14*b* of the endpiece 14 (described below), and is wound onto the takeup reel 18*b*. In FIG. 2, the arrows on the tape 16 indicate the direction of unwinding.

The casing 12 also houses a portion of the endpiece 14. More particularly, the endpiece 14 extends in a longitudinal direction X and in a lateral direction Y, and comprises an attachment portion 14*a*, an applicator portion 14*b*, and a stem 14*c* connecting the attachment portion 14*a* to the applicator portion 14*b*. The attachment portion 14*a* is configured to assemble the endpiece 14 to the casing 12. The stem 14*c* extends longitudinally between the attachment portion 14*a* and the applicator portion 14*b*. The applicator portion 14*b* is configured to apply the coating of the tape 16 on a substrate. In this example, the attachment portion 14*a* and the stem 14*c* are housed completely inside the casing whereas the applicator portion 14*b* extends in part outside the casing 12. The applicator portion 14*b* includes an applicator edge 14*ba* extending in the lateral direction Y, this applicator edge 14*ba* being configured to co-operate with the tape by bearing against the face of the tape that is opposite from its face carrying the coating. In this example, the applicator edge 14*ba* is distinct from the distal end of the endpiece 14. Naturally, in a variant, the distal end of the endpiece and the applicator edge coincide.

The stem 14*c* is elastically deformable and it is a iso-stress stem. Thus, below, and unless specified to the contrary, whatever the state of bending of the stem 14*c*, the longitudinal direction X of the endpiece 14 is the direction that passes through a first reference point of the attachment portion 14*a* and through a second reference point of the applicator portion 14*b*. By way of example, the first reference point is stationary during bending of the stem 14*c*. In this example, the first reference point is the mid-point C of the segment [AB] defined by the intersection between the straight line G extending the neutral axis F of the stem 14*c* when the stem 14*c* is not bent (position shown in continuous lines in FIG. 4A) and the general outside shape of the attachment portion 14*a* in the connection zone between the stem 14*c* and the attachment portion 14*a* (see FIG. 4B). The second reference point is the point of intersection E between the straight line G extending the neutral axis F of the stem 14*c* when the stem 14*c* is not bent, and the distal end portion 15 of the applicator portion 14*b*.

Figure 4A:
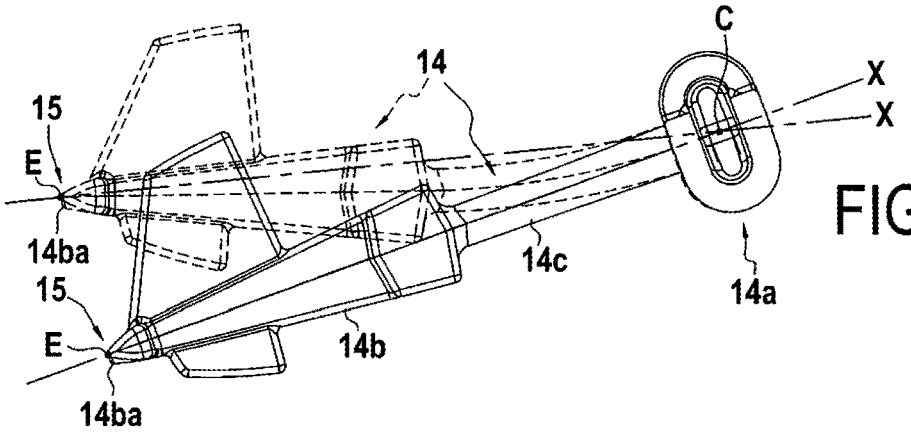
FIG. 4A shows the shape of the endpiece both when it is not subjected to any stress, and also when it is subjected to a bending stress.
Figure 4B:
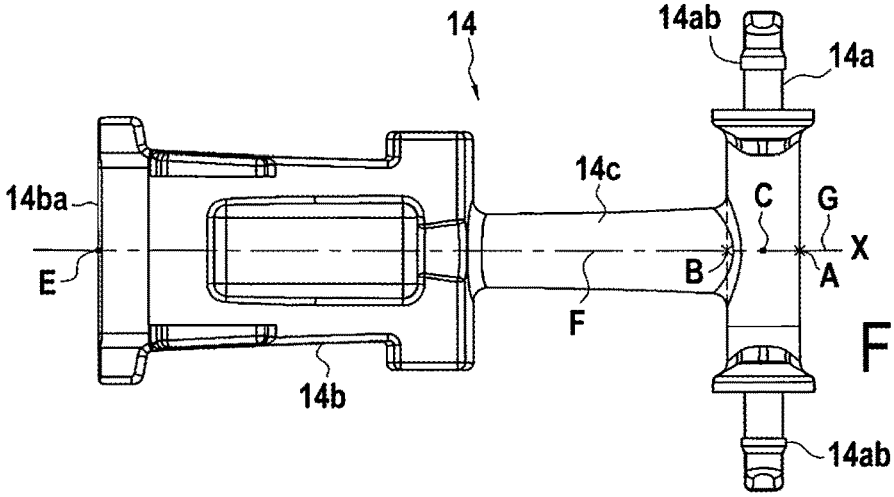
FIG. 4B shows the endpiece as seen looking along arrow B of FIG. 2

In this example, as can be seen in FIGS. 4A and 4B, the stem 14*c* presents a cross section that is strictly decreasing going from the attachment portion 14*a* to the applicator portion 14*b*. In this example, the cross section is elliptical in shape.

By means of the elasticity of the stem 14*c*, the applicator portion 14*b* is movable, within the casing 12, between a rest position (see FIG. 5A) and an application position (see FIG. 5B). The shape of the endpiece 14 in the rest position is shown in FIG. 3, whereas the shape of the endpiece 14 in the application position is shown in dashed lines in FIG. 4A.

The attachment portion 14*a* includes a bar 14*aa* extending in the lateral direction Y and presenting an oblong-shaped cross section. The ends 14*aa*1 and 14*aa*2 of this bar 14*aa* are engaged in respective housings 12Ia and 12IIa of the half-casings 12I and 12II and they co-operate by interfitting shapes with the walls of the housings. Thus, by means of this oblong shape, the bar 14*aa* is prevented from turning about the lateral direction Y. In this example, the end portions of the bar 14*aa* are fitted with snap-fastener portions in relief 14*ab* for fastening the bar 14*aa* by snap-fastening to each half-casing 12I and 12II, portions in relief of complementary shape that are not shown being formed in the walls defining the housings 12Ia and 12IIa. In addition, two endplates 14*ac* and 14*ad* form shoulders for limiting engagement in the lateral direction Y of each end 14*aa*1 and 14*aa*2 in the respective housings 12Ia and 12IIa. In addition, the endplate 14*ad* presents a cutout portion co-operating by interfitting shapes with a projection 12IIa1 extending in the lateral direction Y from the periphery of the housing 12IIa, whereby the endplate 14*ad* and the projection 12IIa1 form a keying system making it easier to mount the endpiece 14 correctly in the casing 12.

Each half-casing 12I and 12II presents a first abutment 12Ib, 12IIb and a second abutment 12Ic, 12IIc opposite the first abutment. The endpiece 14 is disposed between the first abutments 12Ib, 12IIb and the second abutments 12Ic, 12IIc.

Figure 3:
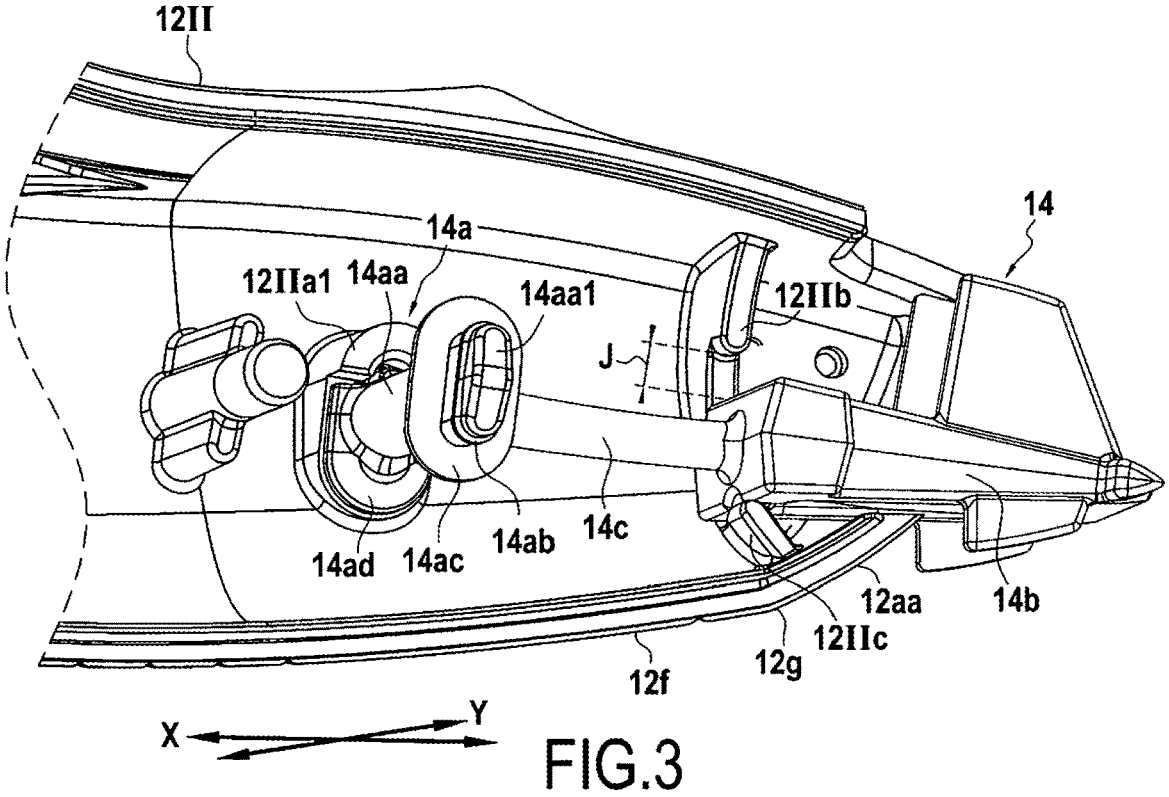
FIG. 3 shows a detail of the endpiece assembled to a shell of the casing.

The following description makes reference to FIG. 3 showing in more detail the arrangement of the endpiece 14 in the half-casing 12II, but naturally this description also applies to the half casing 12I, the abutments 12Ib and 12Ic being arranged symmetrically to the abutments 12IIb and 12IIc about the midplane extending along the longitudinal direction X and perpendicular to the lateral direction Y of the applicator portion 14*b*. The first abutment 12IIb is configured, when the applicator portion 14*b* passes from the rest position to the application position, to limit the movement of the applicator portion 14*b* in a direction that is perpendicular both to the longitudinal direction X and to the lateral direction Y. In the rest position, the first abutment 12IIb and the applicator endpiece 14, and more particularly in this example the applicator portion 14*b*, are spaced apart by clearance J. In this example, the first abutments 12IIb and 12Ib co-operate in abutment with the endpiece 14, and more particularly with the applicator portion 14*b*, in the vicinity of the connection between the stem 14*c* and the applicator portion 14*b*. More particularly, in this example, the first abutments 12IIb and 12Ib co-operate in abutment with the portion of the applicator portion 14*b* that is adjacent to the stem 14*c*. The second abutment 12IIc co-operates with the applicator portion 14*b* in the rest position by pressing thereagainst (position shown in FIG. 3), whereby the stem 14*c* in the rest position is prestressed in bending in the direction that is perpendicular both to the longitudinal direction X and to the lateral direction Y.

FIG. 4A shows in continuous lines the endpiece 14 when it is not subjected to any stress, whereas it shows in dashed lines the endpiece 14 when the applicator portion 14*b* is in the application position, the stem 14*c* then being bent. Thus, in the rest position shown in FIG. 3, the endpiece 14 has an intermediate configuration between the two extreme configurations shown in FIG. 4A.

In this example, the stiffness of the stem 14*c* in bending is 0.88 N/mm while the second abutments 12Ic and 12IIc impose a movement of 0.74 mm. Consequently, the prestress to which the stem 14*c* is subjected is of 0.88 N/mm×0.74 mm=0.65 N.

In addition, the clearance J between the applicator portion 14*b* and the first abutments 12Ib and 12IIb in the direction perpendicular to the longitudinal and lateral directions is 1.8 mm, whereby a force of 1.6 N is required to bring the applicator portion into the application position (i.e. pressing against the first abutments 12Ib and 12IIb so as to eliminate the clearance J). The force required for driving the mechanism 20 and to unwind the tape and for peeling off the coating from the tape 16 so as to transfer it onto a substrate (i.e. the force for depositing the coating on a substrate) is 0.7 N. In this example, the force required for bringing the applicator portion 14*b* into the application position is greater than the force required for depositing the coating on a substrate. Naturally, in a variant, the force required for bringing the applicator portion into the application position is less than the force required for depositing the coating on a substrate, thereby ensuring that it is impossible for the user to deposit the coating while the applicator portion is not in the application position.

In addition, since the tape 16 has a width of 5.0 mm, and considering that the contact between the tape 16 and the substrate corresponds to a 0.2 mm arc on the surface of the applicator edge 14*ba*, which has a radius of curvature of 0.15 mm, the contact area between the tape 16 and the substrate is 1.0 $mm^2$, whereby the application pressure required for applying the tape on the substrate is 0.7 N/1.0 $mm^2$=0.7 MPa.

As shown in FIG. 5A, in the rest position, the applicator portion 14*b* is partly outside the curve CC resulting from geometrically extending the curved shape of the wall 12*ff* of the intermediate portion 12*f* of the casing 12, which portion is designed to face the substrate during application. More particularly, in this example, the applicator portion includes bottom cheeks 14*bb* and top cheeks 14*bc* for guiding the tape 16, the bottom cheeks 14*bb* being partly outside the curve CC in the rest position. Such a configuration generates a degree of inconvenience for the user, who is unable to make contact with the applicator edge 14*ba* if the manual device is not sufficiently tilted relative to the substrate S. In other words, by means of this configuration, it is possible to make contact between the substrate S and the applicator edge 14*ba* only if the angle α between the longitudinal direction X and the substrate S is greater than or equal to a predetermined value. In this example, the predetermined value of the angle α is equal to 40°.

As shown in FIG. 5B, in the application position, the applicator portion 14*b* is arranged inside the circle CC. In addition, in the application position, the angle β, between the longitudinal direction X and the straight line H passing through the applicator edge 14*ba* and the junction 12*g* between the intermediate portion 12*ff* and the distal end portion 12*aa* of the casing 12, is equal to 29°. By means of this configuration, it is ensured that the angle α is greater than or equal to the angle β, so that the user adopts a position that is tilted relative to the substrate S and that favors depositing the coating carried by the tape 16 correctly on the substrate S. In FIG. 5B, the endpiece 14 is shown with the bottom cheeks 14*bb* in contact with the substrate S, but this configuration corresponds to the example in which the angle α is at its minimum value when in the application position. Naturally, during application it is possible, and even preferable, to have the bottom cheeks 14*bb* separate from the substrate S, and consequently to increase the value of the angle α, which generates application conditions that are even more favorable.

Although the present invention is described with reference to specific embodiments, it is clear that modifications and changes may be made to these embodiments without going beyond the general ambit of the invention as defined by the claims. In particular, individual characteristics of the various embodiments shown and/or mentioned may be combined in additional embodiments. Consequently, the description and the drawings should be considered in a sense that is illustrative rather than restrictive.

The invention claimed is:

1. A manual applicator device for applying a coating on a substrate by means of a tape, comprising: an applicator endpiece assembled to a casing and projecting from the casing, said casing having a first abutment and a second abutment, the applicator endpiece extending along a longitudinal direction and a lateral direction, the applicator endpiece comprising an attachment portion for assembling it to the casing, an applicator portion for applying the coating on the substrate, and a stem extending along the longitudinal direction between the attachment portion and the applicator portion, the stem being elastically deformable in such a manner that the applicator portion is movable between a rest position and an application position, the stem being an iso-stress stem, wherein the attachment portion further includes an oblong-shaped bar extending in the lateral direction, and wherein the oblong-shaped bar includes opposing end plates that form shoulders configured for limiting engagement in the lateral direction, wherein the second abutment cooperates with the applicator portion in the rest position by pressing thereagainst, whereby the stem in the rest position is prestressed in bending in a direction that is perpendicular both to the longitudinal direction and to the lateral direction.

2. A manual device according to claim 1, wherein the stem presents a cross section that is strictly decreasing in the longitudinal direction going from the attachment portion to the applicator portion.

3. An applicator device according to claim 1, wherein the first abutment is configured, when the applicator portion passes from the rest position to the application position, to limit the movement of the applicator portion in a direction that is perpendicular both to the longitudinal direction and to the lateral direction.

4. An applicator device according to claim 3, wherein between the first abutment and the applicator endpiece there is a clearance that in the rest position is greater than or equal to 1.0 mm.

5. An applicator device according to claim 1, wherein the bending stiffness of the stem lies in the range 0.13 N/mm to 1.35 N/mm, while the application pressure required for applying the coating of the tape on the substrate lies in the range 0.10 MPa to 1.02 MPa.

6. An applicator device according to claim 1, wherein the casing presents an intermediate portion, said intermediate portion presenting a wall designed to face the substrate during application, said wall presenting a curved shape, the applicator portion in the rest position being arranged at least partly outside the curve resulting from geometrically extending the curved shape of the wall, and inside the curve in the application position.

7. An applicator device according to claim 1, wherein the applicator endpiece presents an applicator edge, while the casing presents an intermediate portion and a distal end portion separated by a junction, an angle between a straight line passing through the applicator edge and the junction between the intermediate portion and the distal end portion of the casing, and the longitudinal direction is greater than 40° in the application position.

* * * * *